US009238883B2

(12) United States Patent
Koike et al.

(10) Patent No.: US 9,238,883 B2
(45) Date of Patent: Jan. 19, 2016

(54) HORIZONTAL ROTARY HOOK OF SEWING MACHINE

(71) Applicant: JANOME SEWING MACHINE Co., Ltd., Tokyo (JP)

(72) Inventors: Mikio Koike, Tokyo (JP); Yasuhiro Osanai, Tokyo (JP); Yasuhiko Komiya, Tokyo (JP)

(73) Assignee: JANOME SEWING MACHINE CO., LTD., Tokyo (JP)

( * ) Notice: Subject to any disclaimer, the term of this patent is extended or adjusted under 35 U.S.C. 154(b) by 0 days.

(21) Appl. No.: 14/550,832

(22) Filed: Nov. 21, 2014

(65) Prior Publication Data

US 2015/0308024 A1 Oct. 29, 2015

(30) Foreign Application Priority Data

Apr. 24, 2014 (JP) ..... 2014-090427

(51) Int. Cl.
*D05B 57/20* (2006.01)
*D05B 57/26* (2006.01)
*D05B 57/14* (2006.01)

(52) U.S. Cl.
CPC ..... *D05B 57/143* (2013.01); *D05B 57/20* (2013.01); *D05B 57/26* (2013.01)

(58) Field of Classification Search
CPC ..... D05B 57/00; D05B 57/02; D05B 57/04; D05B 57/14; D05B 57/20; D05B 57/26; D05B 57/146
USPC ..... 112/181, 231
See application file for complete search history.

(56) References Cited

U.S. PATENT DOCUMENTS

| | | | | | |
|---|---|---|---|---|---|
| 2,394,369 | A * | 2/1946 | Colegrove | D05B 57/20 | 112/228 |
| 3,911,841 | A * | 10/1975 | Johnson | D05B 57/20 | 112/184 |
| 4,284,017 | A * | 8/1981 | Starr | D05B 57/26 | 112/181 |
| 4,429,649 | A * | 2/1984 | Eguchi | D05B 57/143 | 112/229 |
| 6,082,278 | A * | 7/2000 | Asao | D05B 57/26 | 112/231 |
| 7,171,914 | B2 * | 2/2007 | Ota | D05B 57/20 | 112/231 |
| 2010/0126399 | A1 * | 5/2010 | Cerliani | D05B 69/32 | 112/231 |

FOREIGN PATENT DOCUMENTS

| | | | |
|---|---|---|---|
| GB | 747528 | A * | 4/1956 |
| JP | 2006-094905 | A | 4/2006 |

* cited by examiner

*Primary Examiner* — Ismael Izaguirre
(74) *Attorney, Agent, or Firm* — McGinn IP Law Group, PLLC

(57) ABSTRACT

Provided is a horizontal rotary hook for a sewing machine including: an inner rotary hook including an attracted member made of metal in an outer lower surface portion; a permanent magnet that attracts the inner rotary hook; a magnet plate that accommodates the permanent magnet and is provided with a shaft hole for mounting at a center of a diameter thereof; a non-metallic outer rotary hook that accommodates the magnet plate and has a shaft hole at a center of a diameter of an inner bottom portion thereof; and a hook supporting shaft that is inserted through the shaft hole of the magnet plate and the shaft hole of the outer rotary hook, and that includes, at an upper end thereof, a flange for rotatably supporting the outer rotary hook and the magnet plate. A rotation stopper for the magnet plate is disposed to be positioned more inward than an outer circumference edge of the permanent magnet placed in the magnet plate.

7 Claims, 4 Drawing Sheets

CROSS SECTIONAL VIEW IN ARROWS X1-X1

Fig.2A
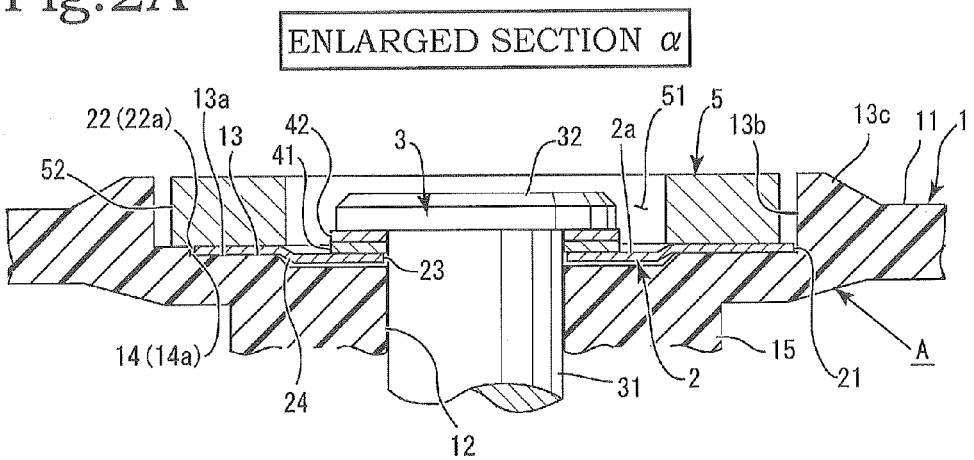
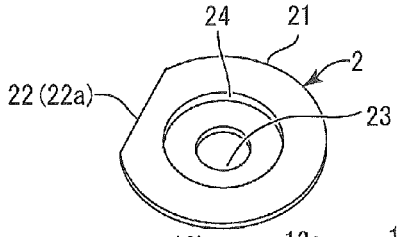
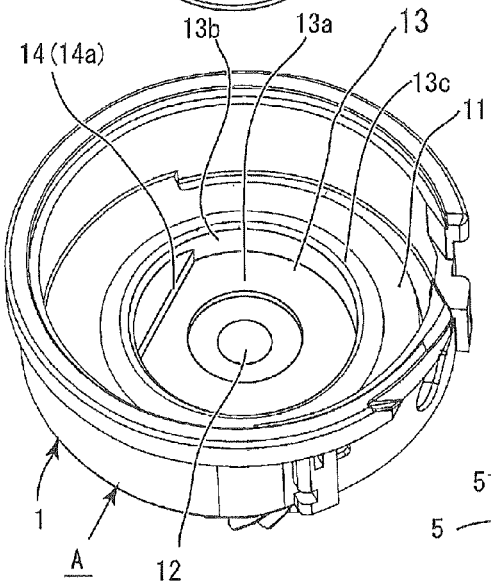
Fig.2B
Fig.2C
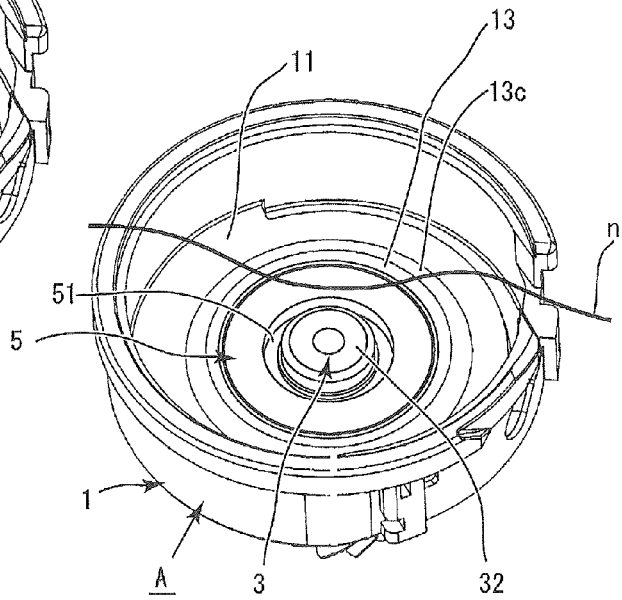

Fig.3A
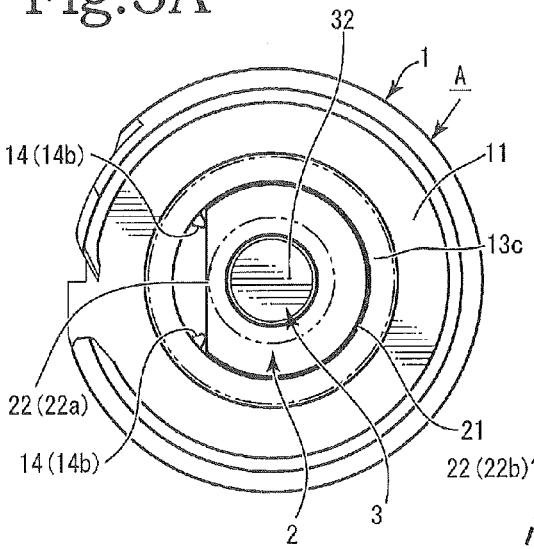
Fig.3B
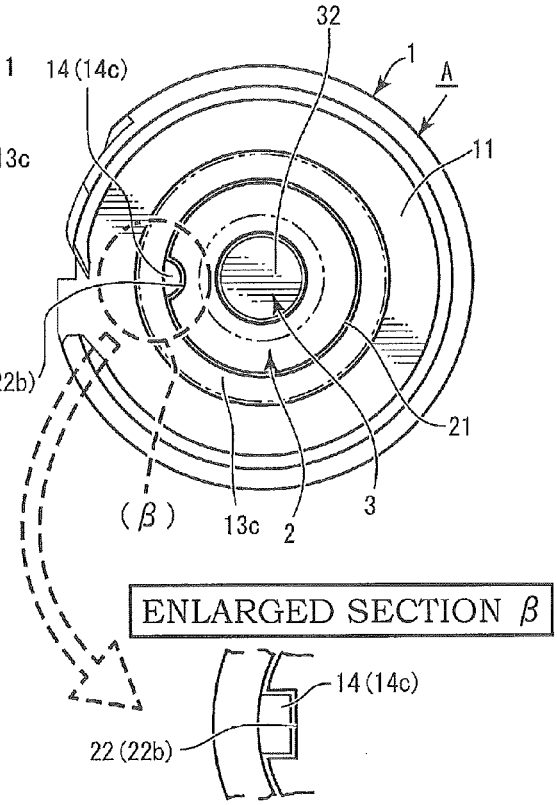
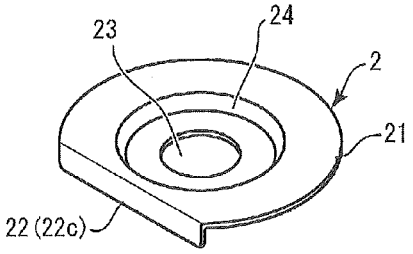
Fig.3D
Fig.3C

HORIZONTAL ROTARY HOOK OF SEWING MACHINE

BACKGROUND OF INVENTION

1. Field of the Invention

The present invention relates to a horizontal rotary hook of a sewing machine that can have an extremely simple configuration and includes a configuration in which a permanent magnet for disposing, in an outer rotary hook, an inner rotary hook having a metal plate in a bottom portion is fixed to a bottom portion of the outer rotary hook.

2. Description of the Related Art

Generally, sewing machines include a horizontal rotary hook device accommodating a bobbin. The horizontal hook device includes outer and inner rotary hooks. A gear shaft is integrally attached to a lower end surface of the outer rotary hook. A gear is fixedly mounted to a lower shaft and meshes with the gear shaft. Thus, the outer rotary hook rotates along with the rotation of the lower shaft. The inner rotary hook accommodated in the outer rotary hook might make random movement such as oscillation during a sewing operation. Such random movement of the inner rotary hook causes noise and affects sewing performance. Japanese Patent Application Laid-open No. 2006-94905 discloses a specific configuration for addressing this problem. Specifically, the configuration is one of various configurations in which a magnet is used to prevent the inner rotary hook accommodated in the outer rotary hook from floating during the sewing operation.

Japanese Patent Application Laid-open No. 2006-94905 can achieve a state where the inner rotary hook in the outer rotary hook is extremely stable, and thus can solve various problems attributable to the random movement of the inner rotary hook. The outer rotary hook may be made of a metal material as a magnetic material, so that the configuration where the inner rotary hook is magnetically attracted to be fixed is easily achieved. However, in recent years, the outer rotary hook has been made of a synthetic resin material as a non-magnetic material in many cases for the sake of cost and the like. Thus, the magnet is fixedly attached to the bottom surface of the outer rotary hook made of the synthetic resin with an adhesive, an adhesive tape, and the like.

When the adhesive or the adhesive tape is used for the fixing, contact surfaces of the inner rotary hook and the magnet need to be cleaned so that the magnet and the inner rotary hook favorably adhere to each other, the bottom surface of the outer rotary hook needs to be cleaned, and even a degreasing treatment is required to remove oil. The adhesiveness of the adhesive is low unless such treatments are sufficiently performed. Thus, the magnet is likely to be detached from the bottom surface of the outer rotary hook while the sewing machine is under operation. However, the cleaning of the bottom surface of the outer rotary hook and the removal of oil (degreasing treatment) require additional cumbersome operation steps which in turn complicate an assembling operation.

Thus, in the configuration of Japanese Patent Application Laid-open No. 2006-94905, a yoke member formed of a magnetic body is mounted to a bottom portion of the outer rotary hook, and a magnet piece is fixedly attached to the yoke member. The yoke member has a form of a plate, and includes a circular circumferential wall. The circumferential wall is not continuously formed in the circumferential direction. The circumferential wall is partially notched at an equal interval to form a plurality of protrusions that engage with ribs of the outer rotary hook. Thus, the yoke member can be fixed in a stable state, without rotating without the outer rotary hook (see FIG. 4A).

Unfortunately, in this configuration, a needle thread n of the bobbin is likely to be caught by the notches in the circumferential wall, defined by the protrusions of the yoke member or an engaging portion between the protrusions and the ribs (see FIG. 4B), to hamper the sewing operation of the sewing machine (see FIG. 4). Furthermore, to form the protrusions and the like on the yoke member, steps for manufacturing the yoke member are increased and even a unit price of the yoke member might be increased.

Furthermore, forming the notches in the circumferential wall of the yoke member further rises the problem that strong magnetic force of a magnet piece disposed in the yoke member cannot be achieved. A technical goal (object) achieved by the present invention is to fix a fixing holder, for fixing the permanent magnet, stably to the outer rotary hook and prevent a thread extending from the bobbin from being caught in the hook, with an extremely simple configuration that does not use a plurality of protrusions as a rotation stopper.

SUMMARY OF THE INVENTION

The inventors made vigorous studies to achieve the goal. The goal is achieved by a first aspect of the present invention that is a horizontal rotary hook of a sewing machine, including: an inner rotary hook including an attracted member made of metal in an outer lower surface portion; a permanent magnet that attracts the inner rotary hook; a magnet plate that accommodates the permanent magnet and is provided with a shaft hole for mounting at a center of a diameter thereof; a non-metallic outer rotary hook that accommodates the magnet plate and has a shaft hole at a center of a diameter of an inner bottom portion thereof; and a hook supporting shaft that is inserted through the shaft hole of the magnet plate and the shaft hole of the outer rotary hook, and that includes, at an upper end thereof, a flange for rotatably supporting the outer rotary hook and the magnet plate. A rotation stopper for the magnet plate is disposed to be positioned more inward than an outer circumference edge of the permanent magnet placed in the magnet plate.

As a second aspect of the present invention to achieve the goal, the rotation stopper for the magnet plate includes a rotation stopping portion formed at a part of the magnet plate more inward than an outer circumference edge of the permanent magnet placed in the magnet plate, and an engaging portion formed in a position that is in the inner bottom portion of the outer rotary hook, opposes the rotation stopping portion, and is more inward than the outer circumference edge of the permanent magnet, in the horizontal rotary hook of the sewing machine as the first aspect of the present invention.

As a third aspect of the present invention to achieve the goal, the rotation stopping portion of the magnet plate is obtained by forming a part of an outer circumference edge of the magnet plate into a linear notch portion, in the horizontal rotary hook of the sewing machine as the first aspect of the present invention. As a fourth aspect of the present invention to achieve the goal, the rotation stopping portion of the magnet plate is obtained by forming a part of an outer circumference edge of the magnet plate into a curved notch portion, in the horizontal rotary hook of the sewing machine as the first aspect of the present invention.

As a fifth aspect of the present invention to achieve the goal, the rotation stopping portion of the magnet plate is formed by bending a part of an outer circumference edge of the magnet plate, in the horizontal rotary hook of the sewing machine as the first aspect of the present invention. As a sixth aspect of the present invention to achieve the goal, the rotation stopping portion is provided at at least one portion, in the horizontal rotary hook of the sewing machine as the first or the second aspect of the present invention.

In the aspects of the present invention, the magnet plate includes the rotation stopping portion at a circular outer circumference and more inward than the outer circumference edge of the permanent magnet. The engaging portion that is in the form of a step and engages with the rotation stopping portion is formed on an inner circumference surface of an accommodating recess formed in a bottom portion of the outer rotary hook. Thus, the magnet plate can be fixed in the circumferential direction with respect to the bottom portion of the outer rotary hook, without any member for engaging and fixing to the bottom portion (or the accommodating recess formed in the bottom portion) of the outer rotary hook.

An engaged portion between the rotation stopping portion and the engaging portion is positioned more inward than the outer circumference edge of the permanent magnet placed in the magnet plate. Thus, no protrusions, recesses, or the like engaging with each other for fitting and fixing are exposed between the magnet plate and the bottom portion of the outer rotary hook. Thus, a needle thread of a bobbin disposed in the inner rotary hook can be prevented from being caught in the outer rotary hook during a sewing operation of the sewing machine to hamper the sewing operation.

BRIEF DESCRIPTION OF THE DRAWINGS

FIG. 2A is an enlarged view of a section α in FIG. 1A, FIG. 2B is a perspective view of an outer rotary hook and a magnet plate that are separated from each other, and FIG. 2C is a perspective view of a state where a needle thread is not caught by a bottom portion of the outer rotary hook in the present invention;

FIG. 3A is a plan view of a main portion including a modification of the rotation stopper of the first embodiment of the present invention, FIG. 3B is a plan view of a main portion including a rotation stopper of a second embodiment of the present invention, FIG. 3C is a plan view of a main portion including a modification of the rotation stopper of the second embodiment in a section β in FIG. 3B of the present invention, and FIG. 3D is a perspective view of a magnet plate including a rotation stopper of a third embodiment of the present invention.

DESCRIPTION OF THE PREFERRED EMBODIMENTS

Figure 1A:
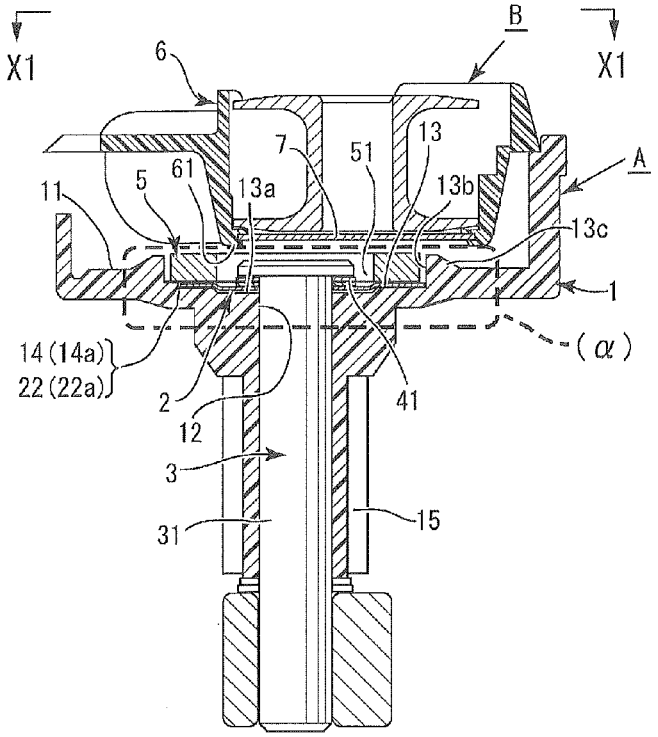
FIG. 1A is a vertical cross-sectional view including a rotation stopper of a first embodiment of the present invention.

Embodiments of the present invention will be described below based on the drawings. As shown in FIGS. 1, 2, and 3, a horizontal rotary hook of the present invention mainly includes an outer rotary hook A, a magnet plate 2, a hook supporting shaft 3, a permanent magnet 5, an inner rotary hook B, and a rotation stopper. The outer rotary hook A mainly includes an outer rotary hook main body 1, a gear shaft 15, and the like (see FIG. 1).

The rotation stopper is provided to the outer rotary hook A and the magnet plate 2. As described later, the rotation stopper includes an engaging portion 14 provided on the side of the outer rotary hook A and a rotation stopping portion 22 provided on the side of the magnet plate 2.

The gear shaft 15 is integrally attached to the outer rotary hook main body 1. A driving gear (not shown) that meshes with the gear shaft 15 rotates the outer rotary hook A. The outer rotary hook main body 1 has a form of a flat cylindrical cup and is made of a synthetic resin such as plastic or nonferrous metal. An opening is formed in an upper portion of the outer rotary hook main body 1. A bottom portion 11 is formed in a lower portion of the outer rotary hook main body 1. The bottom portion 11 has a substantially circular shape (see FIG. 1A).

Figure 1C:
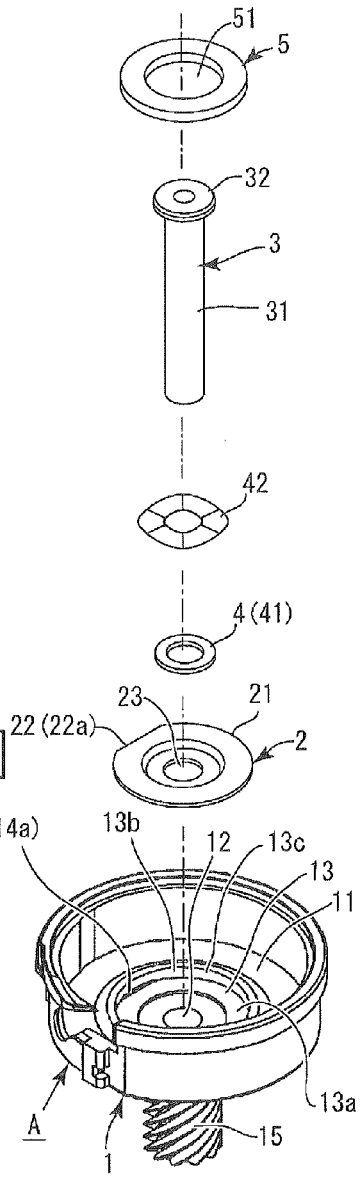
FIG. 1C is a perspective view of a horizontal rotary hook of the present invention in an unassembled state.

An accommodating recess 13 for accommodating the magnet plate 2 is formed in the bottom portion 11 (see FIG. 1A, FIG. 2A, and FIG. 2B). The accommodating recess 13 is a portion forming the bottom portion 11 and thus is a part of the bottom portion 11. The accommodating recess 13 is a circular space. The center of the diameter of the accommodating recess 13 is at a center portion of the bottom portion 11. The magnet plate 2 and the permanent magnet 5 are accommodated in the accommodating recess 13.

An inner circumferential wall 13*b* is continuously formed along a circular bottom surface 13*a* of the accommodating recess 13. A protrusion 13*c*, protruding upward from the bottom portion 11, is formed along the inner circumferential wall 13*b* (see FIGS. 1 and 2A). The engaging portion 14 is formed on the inner circumferential wall 13*b* of the accommodating recess 13. The engaging portion 14 engages with the rotation stopping portion 22 of the magnet plate 2 described later, so that the magnet plate 2 accommodated in the accommodating recess 13 is prevented from rotating alone.

A shaft hole 12 is formed at the center of the bottom portion 11, that is, the center of the circular bottom surface 13*a* of the accommodating recess 13. The position where the shaft hole 12 is formed matches the center of the diameter of the accommodating recess 13. The hook supporting shaft 3 described later penetrates through the shaft hole 12. The gear shaft 15 is formed on a lower surface side of the bottom portion 11. The gear shaft 15 is in the form of a shaft. An outer circumference of the gear shaft 15 is threaded to be in the form of a gear. The gear shaft 15 is orthogonal with respect to the bottom portion 11. The shaft hole 12 is formed along the axial core of the gear shaft 15.

The magnet plate 2 is disposed on a lower side of the permanent magnet 5. The rotation stopping portion 22 formed on the magnet plate 2, that is, the rotation stopping portion 22 for achieving rotation together with the outer rotary hook A, is provided at a portion more inward than the outer circumference edge of the permanent magnet 5.

The rotation stopping portion 22 of the magnet plate 2 may be in various embodiments. As a first embodiment, a linear notch 22*a* as a single rotation stopping portion 22 is formed at a part of an outer circumference of a circular outer circumference edge portion 21 defining a substantially disk shape.

The linear notch 22*a* is an edge portion in a linear or a substantially linear shape to define a substantially D shape in plan view. A shaft hole 23 is formed at the center of the diameter of the magnet plate 2. A step portion 24 in the form of a step extending downward is formed around the shaft hole 23 (see FIGS. 1C and 2A).

The linear notch 22*a* of the first embodiment may be a plurality of linear notches 22*a* formed on the outer circumference of the circular outer circumference edge portion 21. Specifically, two linear notches 22*a* may be symmetrically formed, or three or more linear notches 22*a* may be formed.

Alternatively, the outer circumference of the circular outer circumference edge portion 21 may be partly bent, instead of forming a notch, to obtain the same effect as the linear notch 22*a*.

The engaging portion 14, corresponding to the rotation stopping portion 22 as the linear notch 22*a* of the first embodiment, is a linear step portion 14*a*. The linear step portion 14*a* protrudes from a part of the inner circumferential wall 13*b* of the accommodating recess 13 in a circumference direction (see FIGS. 1B, 1C, and 2B). The linear step portion 14*a* comes into contact with the linear notch 22*a* of the magnet plate 2. The height of the linear step portion 14*a* is set to be substantially the same or slightly smaller than the thickness of the magnet plate 2.

As a modification of the engaging portion 14 corresponding to the rotation stopping portion 22 of the first embodiment, two protruding steps 14*b* protrude from two appropriate portions of the inner circumferential wall 13*b* (see FIG. 3A). The protruding steps 14*b* come into contact with and thus engage with the linear notch 22*a*, whereby the magnet plate 2 is fixed to the accommodating recess 13.

As a second embodiment of the rotation stopping portion 22 of the magnet plate 2, a recess notch 22*b* in the form of a recess is formed at a part of the outer circumference edge of the circular outer circumference edge portion 21 (see FIGS. 3B and 3C). The recess notch 22*b*, which may be in various shapes, has a curved shape or a semicircular shape. As a modification, the recess notch 22*b* may have a rectangular or a square shape (see FIG. 3C).

Although not elaborated in the figures, the recess notch 22*b* may have a substantially triangular shape. In this case, the engaging portion 14, corresponding to the recess notch 22*b*, is an inserted protrusion 14*c* inserted into the recess notch 22*b*. The inserted protrusion 14*c* protrudes from the inner circumferential wall 13*b* towards the center, and has substantially the same shape as the recess notch 22*b*.

A pair of the rotation stopping portion 22 and the inserted protrusion 14*c* are each provided to at least one portion of the corresponding one of the outer peripheral edge of the magnet plate 2 and the inner circumferential wall 13*b*. Thus, the pair of the rotation stopping portion 22 and the inserted protrusion 14*c* may be provided in a plurality.

As a third embodiment of the rotation stopping portion 22 of the magnet plate 2, a bent portion 22*c* is formed by bending a part of the outer circumference edge of the magnet plate 2 (see FIG. 3D). Specifically, the bent portion 22*c* as the rotation stopping portion 22 is formed by providing a linear bend line at the part of the outer circumference edge of the magnet plate 2, and downwardly bending the magnet plate 2 substantially orthogonally at the bend line.

With the bent portion 22*c*, the magnet plate 2 can have higher mechanical strength, that is, rigidity as a whole. The bent portion 22*c* of the magnet plate 2 downwardly extends to be substantially orthogonal with respect to the horizontal portion of the magnet plate 2, and thus can more favorably be in contact with the engaging portion 14 on the side of the outer rotary hook A.

The linear step portion 14*a* corresponds to the third embodiment of the rotation stopping portion 22. The position of the shaft hole 23 of the magnet plate 2 matches the position of the shaft hole 12 of the outer rotary hook A, in a state where the magnet plate 2 is inserted and thus disposed in the accommodating recess 13.

The hook supporting shaft 3 includes a supporting shaft portion 31 and a flange portion 32 formed at an end of the supporting shaft portion 31. The supporting shaft portion 31 of the hook supporting shaft 3 is inserted into the shaft hole 23 of the magnet plate 2 and the shaft hole 12 of the outer rotary hook A. The flange portion 32 comes into contact with a flat surface portion 2*a* around the shaft hole 23 of the magnet plate 2.

When the step portion 24 is formed, the flange portion 32 comes into contact with the step portion 24 so that the outer rotary hook A and the magnet plate 2 are fixed in such a manner as to be capable of rotating together. A washer 41 and a spring washer 42 may be disposed between the flange portion 32 and the flat surface portion 2*a* of the magnet plate 2.

The permanent magnet 5 is in the form of a flat annular plate, and is attracted to the magnet plate 2 to be disposed in the accommodating recess 13 of the outer rotary hook A. A through hole 51 is formed at the center of the permanent magnet 5. The inner diameter of the through hole 51 is larger than the outer diameter of the flange portion 32 of the hook supporting shaft 3. Thus, the flange portion 32 is accommodated within the through hole 51.

The permanent magnet 5 accommodated in the accommodating recess 13 is disposed on the upper surface of the rotation stopping portion 22 of the magnet plate 2. Thus, the rotation stopper including the rotation stopping portion 22 and the engaging portion 14 is positioned more inward than the outer circumference edge of the permanent magnet 5. Thus, since the outer rotary hook A no longer has a portion where the needle thread n is likely to be caught, the needle thread n can be prevented from being caught in the outer rotary hook A (see FIG. 2C).

The inner rotary hook B includes a container main body 6 in the form of a container and an attracted member 7. A bobbin chamber is provided in the inner rotary hook B. A lower surface of the container main body 6 of the inner rotary hook B, that is, a bottom surface 61 is provided with the attracted member 7 formed of a magnetic material. The container main body 6 is made of a synthetic resin such as plastic. Specifically, the attracted member 7 is formed of a metallic thin plate. The attracted member 7 is disposed to be exposed on the lower surface side of the inner rotary hook B.

How the horizontal rotary hook is assembled in the present invention will be described. As described above, the outer rotary hook A has the accommodating recess 13 formed in the bottom portion 11. The magnet plate 2 is disposed in the accommodating recess 13. More specifically, the magnet plate 2 is accommodated in the accommodating recess 13 of the outer rotary hook A with the circular outer circumference edge portion 21 of the magnet plate 2 being accommodated within the accommodating recess 13 and with the rotation stopping portion 22 (linear notch portion 22*a*) being in contact with or adjacent to the engaging portion 14 (linear step portion 14*a*) (see FIGS. 1B and 2A).

Figure 1B:
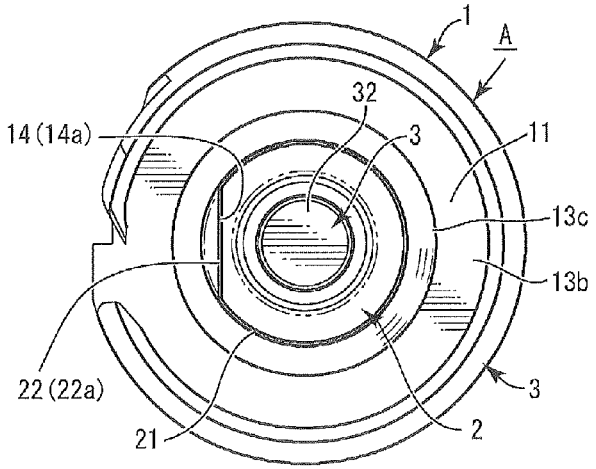
FIG. 1B is a cross-sectional view as viewed in a direction of arrows X1-X1.
Figures 4A, 4B:
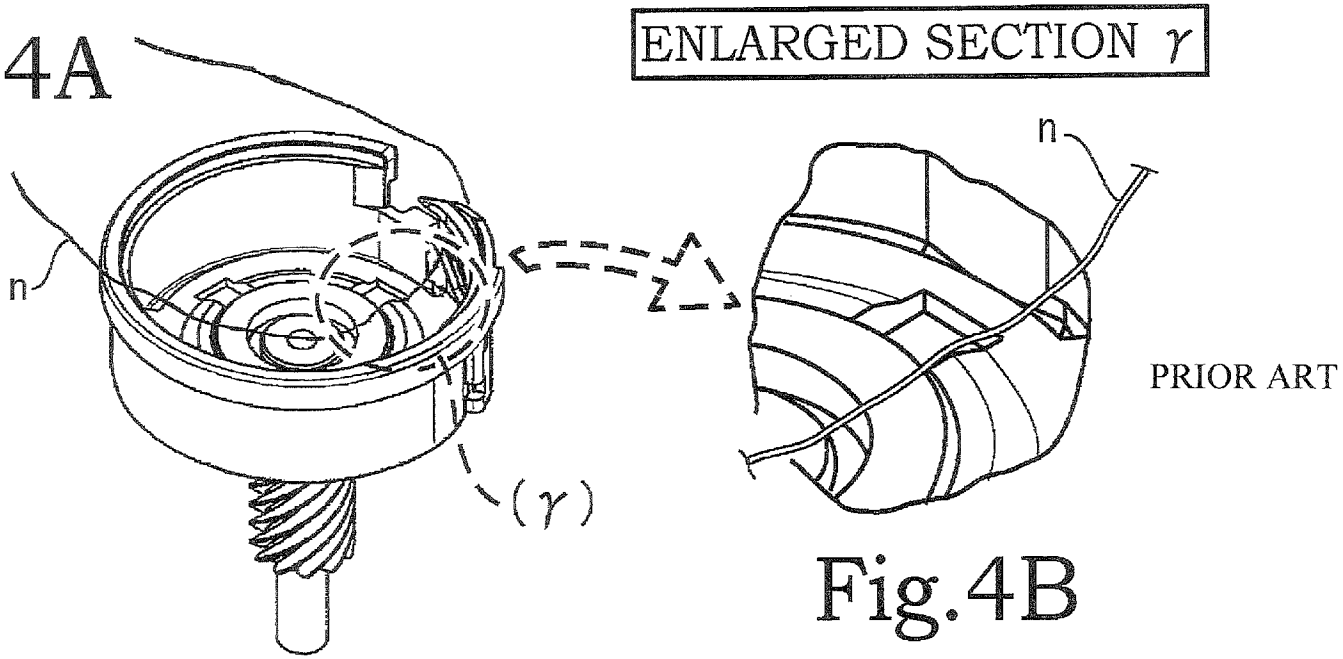
Fig.4A PRIOR ART
Fig.4B PRIOR ART
FIG. 4A is a perspective view of a state where the needle thread is caught by the bottom portion in a conventional technique.
FIG. 4B is a perspective view of a section γ in FIG. 4A.

Thus, the magnet plate 2 inserted and thus disposed in the accommodating recess 13 of the outer rotary hook A is prevented from rotating alone and thus rotates together with the outer rotary hook A (see FIG. 1B). All things considered, when the outer rotary hook A rotates, the magnet plate 2 rotates together with the bottom portion 11.

In the second to the sixth aspects of the invention, the rotation stopping portion and the engaging portion can have extremely simple shapes to be easily disposed more inward than the outer circumference edge of the permanent magnet. When the magnet plate has the rotation stopping portion formed by bending a part of the outer circumference edge of the magnet plate in particular, the rotation stopping portion can improve the mechanical strength, that is, the rigidity of the magnet plate. The portion formed by bending the magnet plate to be orthogonal with respect to the magnet plate, can more favorably be in contact with the engaging portion of the outer rotary hook.

What is claimed is:

1. A horizontal rotary hook of a sewing machine, comprising:

an inner rotary hook including an attracted member made of metal in an outer lower surface portion;

a permanent magnet that attracts the inner rotary hook;

a magnet plate that accommodates the permanent magnet and is provided with a shaft hole for mounting at a center of a diameter thereof;

a non-metallic outer rotary hook that accommodates the magnet plate and has a shaft hole at a center of a diameter of an inner bottom portion thereof; and a hook supporting shaft that is inserted through the shaft hole of the magnet plate and the shaft hole of the outer rotary hook, and that includes, at an upper end thereof, a flange for rotatably supporting the outer rotary hook and the magnet plate, wherein a rotation stopper for the magnet plate is disposed to be positioned more inward than an outer circumference edge of the permanent magnet placed in the magnet plate.

2. The horizontal rotary hook of a sewing machine according to claim 1, wherein the rotation stopper for the magnet plate includes a rotation stopping portion formed at a part of the magnet plate more inward than an outer circumference edge of the permanent magnet placed in the magnet plate, and an engaging portion formed in a position that is in the inner bottom portion of the outer rotary hook, opposes the rotation stopping portion, and is more inward than the outer circumference edge of the permanent magnet.

3. The horizontal rotary hook of a sewing machine according to claim 1, wherein the rotation stopping portion of the magnet plate is obtained by forming a part of an outer circumference edge of the magnet plate into a linear notch portion.

4. The horizontal rotary hook of a sewing machine according to claim 1, wherein the rotation stopping portion of the magnet plate is obtained by forming a part of an outer circumference edge of the magnet plate into a curved notch portion.

5. The horizontal rotary hook of a sewing machine according to claim 1, wherein the rotation stopping portion of the magnet is formed by bending a part of an outer circumference edge of the magnet plate.

6. The horizontal rotary hook of a sewing machine according to claim 1, wherein the rotation stopping portion is provided at at least one portion.

7. The horizontal rotary hook of a sewing machine according to claim 2, wherein the rotation stopping portion is provided at at least one portion.

* * * * *